US005195314A

United States Patent [19]

Stahlecker et al.

[11] Patent Number: 5,195,314

[45] Date of Patent: Mar. 23, 1993

[54] PNEUMATIC SLIVER THREADING DEVICE FOR A SPINNING MACHINE

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 850,317

[22] Filed: Mar. 12, 1992

[30] Foreign Application Priority Data

Mar. 20, 1991 [DE] Fed. Rep. of Germany ..... 4109024

[51] Int. Cl.[5] ..... D01H 13/00

[52] U.S. Cl. ..... 57/279; 57/90

[58] Field of Search ..... 57/281, 90, 279, 261, 57/280, 308

[56] References Cited

U.S. PATENT DOCUMENTS

| | | | |
|---|---|---|---|
| 2,736,162 | 2/1956 | Steinberger | 57/90 X |
| 3,016,679 | 1/1962 | Rakhorst | 57/315 |
| 3,469,385 | 9/1969 | Tsuzuki | 57/90 x |
| 3,564,829 | 2/1971 | Tsuzuki | 57/90 X |
| 3,816,991 | 6/1974 | Takeuchi et al. | 57/90 |
| 4,329,840 | 5/1982 | Gasser et al. | 57/90 X |
| 4,332,130 | 6/1982 | Gasser et al. | 57/90 X |
| 4,357,793 | 11/1982 | Gasser et al. | 57/90 X |

FOREIGN PATENT DOCUMENTS

| | | | |
|---|---|---|---|
| 912680 | 12/1962 | United Kingdom | 57/280 |
| 1183208 | 3/1970 | United Kingdom . | |

*Primary Examiner*—Joseph J. Hail, III

*Attorney, Agent, or Firm*—Evenson, Wands, Edwards, Lenahan & McKeown

[57] ABSTRACT

In the case of a spinning machine comprising several spinning stations for the spinning of yarns from slivers, the cans from which the slivers are withdrawn are deposited above the spinning machine. From the cans, sliver tubes lead to the spinning stations. The spinning machine has a vacuum duct extending in the longitudinal direction of the machine which comprises a connection opening which is closed during the operation for each spinning station. When the operation is interrupted, the connection opening can be opened up and connected with the pertaining sliver tube.

14 Claims, 8 Drawing Sheets

PNEUMATIC SLIVER THREADING DEVICE FOR A SPINNING MACHINE

BACKGROUND AND SUMMARY OF THE INVENTION

The invention relates to a spinning machine having several spinning stations for the spinning of yarns from slivers which are withdrawn from cans which are deposited above the spinning machine and from which sliver tubes lead to the spinning stations.

A spinning machine of this type is known from the British Patent Document GB-PS 11 83 208. The sliver from the cans, which are deposited in a separate space above a two-sided ring spinning machine, are guided to the individual spinning stations by way of sliver tubes. Between the cans and the sliver tubes, two deflection rollers are arranged which may be driven. The sliver tubes may extend along several floors and are therefore quite long. In the case of the known spinning machine, it is therefore difficult, after an operational stoppage, to again guide a newly fed sliver to the spinning station which is situated far away from it.

It is an object of the invention to avoid this disadvantage and to provide a spinning machine where the feeding of slivers to the corresponding spinning stations is facilitated.

This object is achieved according to preferred embodiments of the invention in that a vacuum duct is provided which extends in the longitudinal direction of the machine and which, for each spinning station, has a connection opening which is closed during the operation and which, when the operation is interrupted, can be opened up and can be connected with the pertaining sliver tube.

When the operation of a spinning station is interrupted, the pertaining sliver tube can therefore be connected to a suction duct, whereby the sliver, possibly with the participation of drivable deflection rollers situated in the area of the cans, can be sucked in up to the area of a spinning station. This construction is particularly advantageous when slivers which are finer than those which had been normal up to now are fed, particularly of sizes of from Nm 0.4 to 0.8, and when these slivers are, in addition, transported along fairly long paths. The danger of faulty drafts can then be avoided. Advantageously, it may also be provided that the slivers are provided with a true twist during the feeding to the pertaining spinning station as well as during the operation, for example, by rotating the cans about their axes. It will then be possible, for example, in the case of ring spinning machines, to do without any preconnected machine, such as the flyer.

In an expedient development of the invention, the mouth of the sliver tube which faces the spinning station is provided in the direct proximity of the connection opening. As a result, no long paths must be bridged when the mouth of the sliver tube is connected to the connection opening of the vacuum duct. In this case, it is also advantageous for the connection openings to be arranged on the top side of the vacuum duct.

Advantageously, the area of the mouth of the sliver tube is guided in a restricted manner. As a result, the connecting of the mouth of the sliver tube with the pertaining connection opening is facilitated, particularly when the mouth of the sliver tube of the connection opening can be applied in the vertical direction.

In an advantageous development of the invention, a joint closing element is provided for several connection openings. This takes into account the circumstance that, particularly after a change of lots, the leading of slivers to the individual spinning stations is required; that is, particularly when new cans with new fiber material are supplied to all spinning stations of a spinning machine.

Other objects, advantages and novel features of the present invention will become apparent from the following detailed description of the invention when considered in conjunction with the accompanying drawings.

DETAILED DESCRIPTION OF THE DRAWINGS

Figure 1:
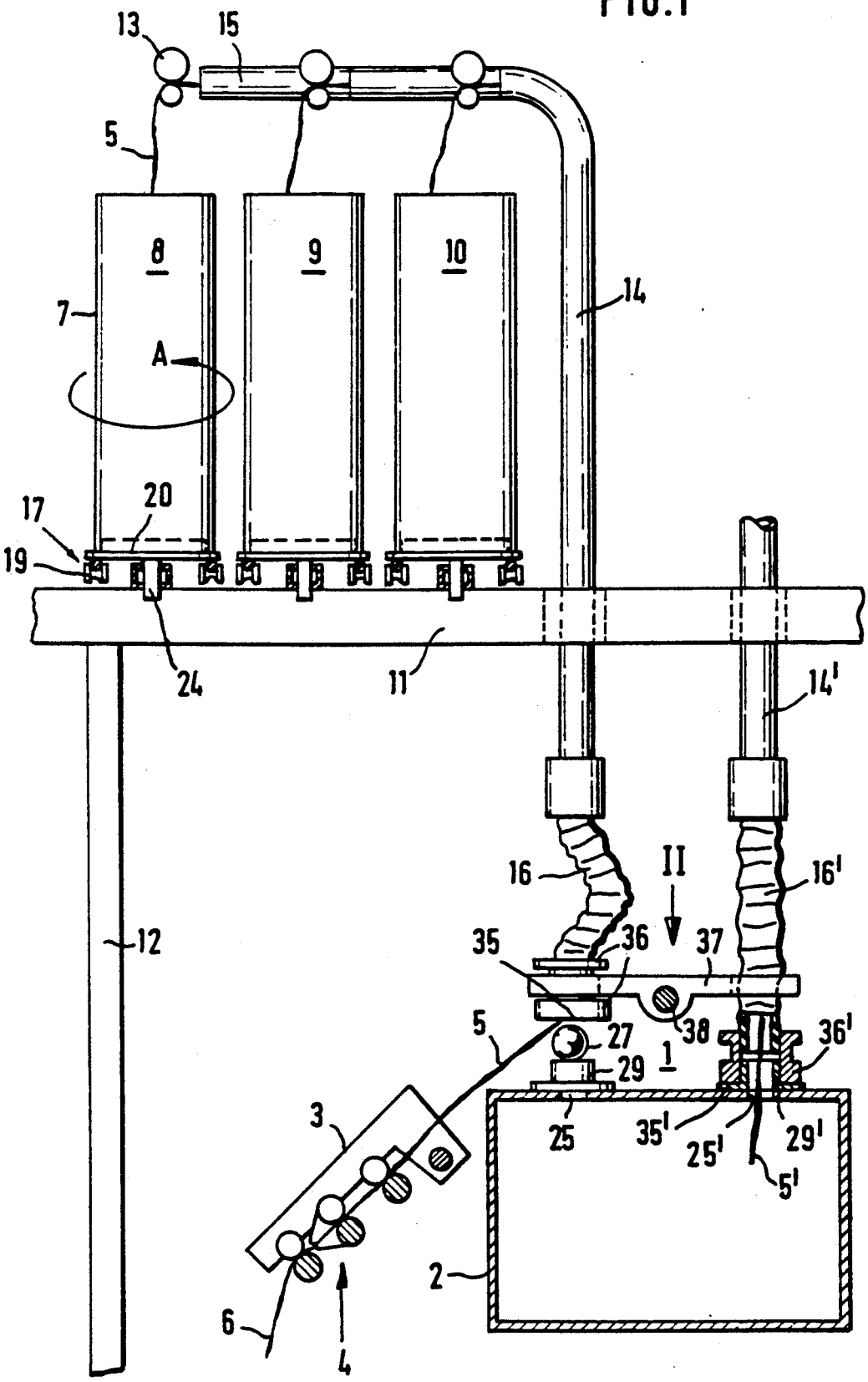
FIG. 1 is a lateral schematic view of a section of a machine system in which sliver tubes lead to spinning stations from cans deposited above the spinning machine, constructed according to preferred embodiments of the invention.

FIG. 1 shows, as part of a spinning machine 1, only a vacuum duct 2 extending in the longitudinal direction of the machine as well as a drafting unit 3 of a spinning station 4. On each side of the spinning machine I a plurality of spinning stations 4 are provided which are arranged next to one another. The spinning stations 4 are used for the spinning of slivers 5 into yarns 6. The pertaining twisting elements of the spinning stations are not shown.

Figure 5:
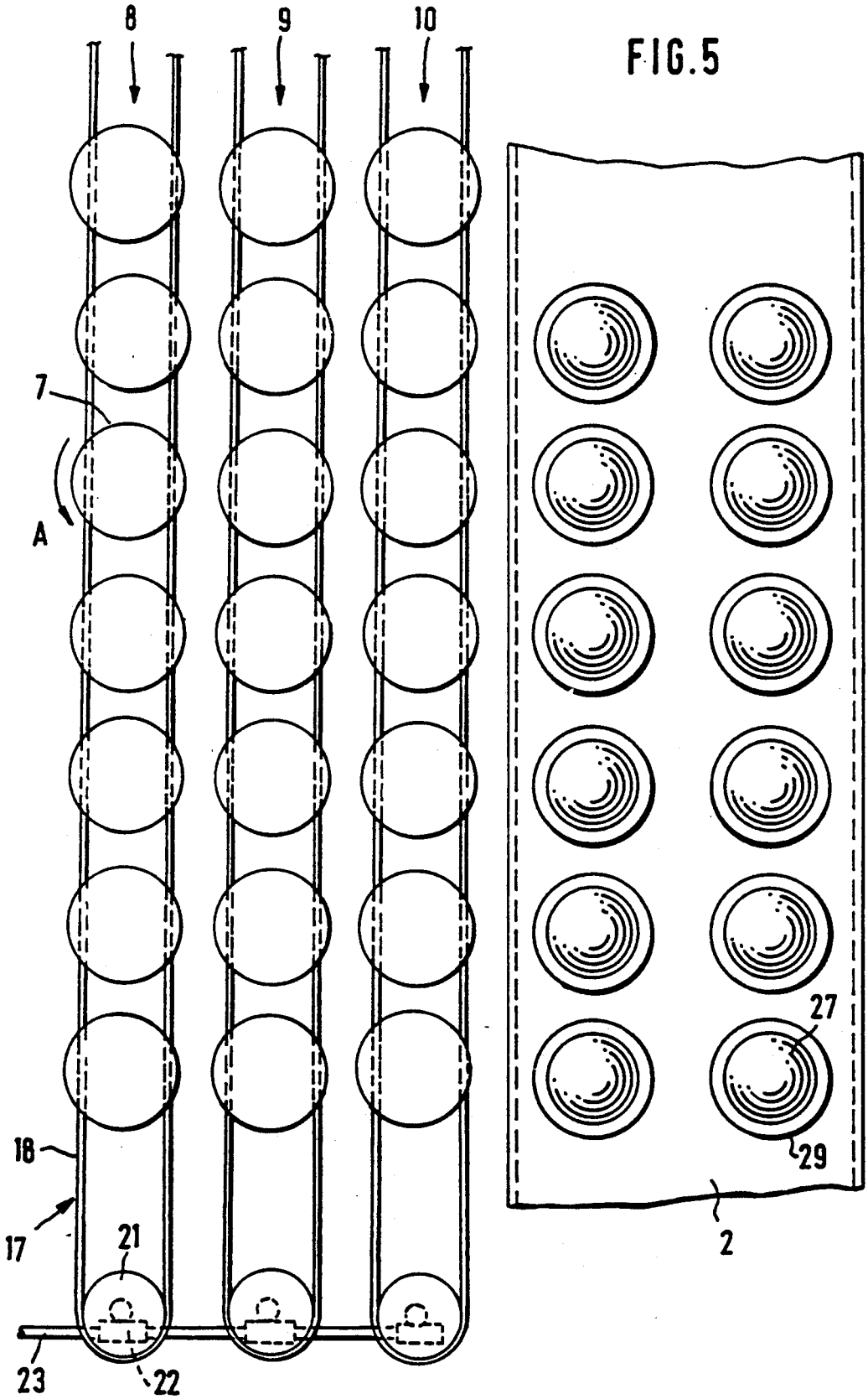
FIG. 5 is a schematic top view of FIG. 1, in which case several components are not shown in order to better depict the arrangement.

The slivers 5 are deposited in cans 7 from which they are fed to the individual spinning stations 4. Since the diameters of the cans are generally larger than the distance between two spinning stations 4 in the longitudinal direction of the spinning machine 1, the cans 7 for each side of the machine are arranged in several rows 8, 9, and 10; see also FIG. 5. The cans 7 are deposited on a platform 11 which is situated above the spinning machine 1 and is supported by means of supports 12. As a result, the slivers 5 are fed to the drafting units 3 of the spinning stations 4 from above.

The sliver 5, which is taken out of the respective can 7, is fed by way of a preferably drivable roller pair 13 to a sliver tube 14 which starts with a horizontal part 15 and is then guided in the vertical direction through the platform 11. The part of the sliver tube 14 facing the drafting unit 3, in this case, may be formed by a flexible hose 16.

So that slivers 5 can be fed to the spinning machine 1 which are finer than previously, the slivers 5 are truly twisted before they reach the spinning stations 4. For this purpose, the cans 7 are connected to a rotary drive 17; see also FIG. 5. This rotary drive 17 comprises a wire cable 18 which runs by way of guide pulleys 19 and on which can plates 20 rest on which the cans 7 are deposited and by which the cans 7 are centered in the radial direction. The can plates 20 are supported on the wire cable 18 by their own weight and are driven by the wire cable 18 in the direction of the arrow A.

In the present case, a separate wire cable 18 is assigned to each of the rows 8, 9, and 10 of the cans 7. Cable 18 is driven by a driving disk 21 which can be driven by way of an angle drive 22 by a shaft 23 extending transversely to the spinning machine 1.

The can plates 20 are each non-rotatably connected with a pin 24 which is rotatably disposed in the platform 11 in a manner not shown in detail.

Figure 3:
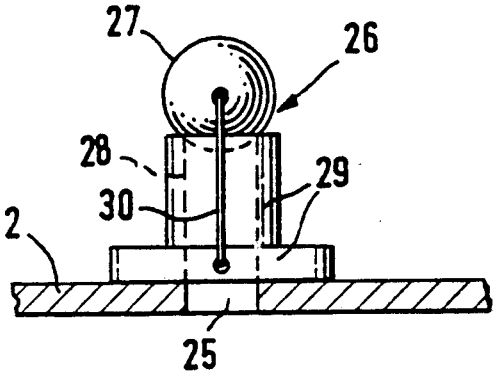
FIGS. 3 and 4 each are views of a closing element for a connection opening of a vacuum duct, constructed in accordance with different preferred embodiments of the invention.

The vacuum duct 2 of the spinning machine 1 is disposed in the machine center between and far upwards of the drafting units 3 of the two machine sides. On its top side, duct 2 has connection openings 25 which are closed by closing elements 26 during the operation of the spinning stations 4; see also FIGS. 3, 4 and 5. According to FIG. 3, the connection openings 25 are closed, for example, by means of closing balls 27 which cover a bore 28 of a connecting sleeve 29 disposed on the connection opening 25. The closing ball 27 may consist of rubber and may be held on the connecting sleeve 29 by means of a rubber cord 30. For the opening-up of the connection opening 25, the closing ball 27 can easily be removed.

Figure 4:
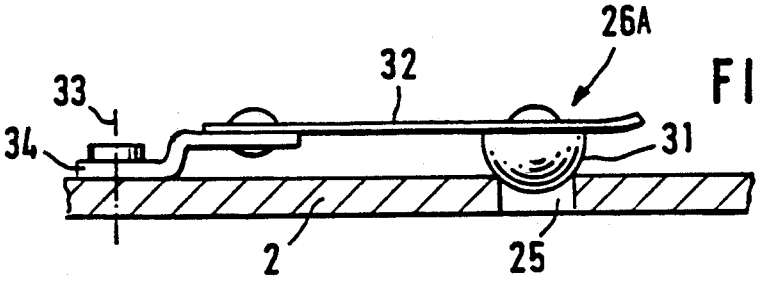

According to FIG. 4, the closing element 26 consists of a rubber hemisphere 31 which is fastened to a leaf spring 32. Therefore, the rubber hemisphere 31, after a slight lifting, can be swivelled about a shaft 33 of its holding device 34, whereby the connection opening 25 can be opened up.

Figure 2:
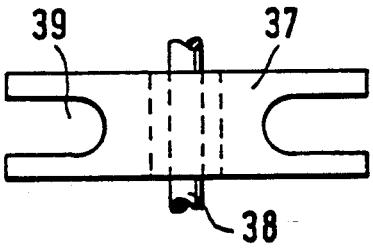
FIG. 2 is a view of a detail of FIG. 1 in the direction of the arrow II.

During the normal spinning operation of a spinning station 4 which is illustrated in FIG. 1 on the lefthand side of the vacuum duct, the individual connection openings 25 are closed. In this case, the mouth 35 of the sliver tube 14 is disposed above the connection opening 25 at a relative close distance to it. In this case, the mouth 35 is part of a counterpiece 36 which, during the operation, can be hung into a fork 37; see also FIG. 2. Such a fork 37 is assigned to each spinning station 4 and is provided for both sides of the machine. The individual forks 37 are held on a rod 38 extending in the longitudinal direction of the machine. Each side of the machine comprises a recess 39 of the fork 37 for receiving the counterpiece 36 during the operation.

For the right-hand side of the vacuum duct 2, FIG. 1 illustrates a sliver tube 14', the mouth 35' of which is connected with the pertaining connection opening 25' for the taking-in of a sliver 5'. For this purpose, the counterpiece 36', after the removal of the closing ball 27, was placed on the connecting sleeve 29', which was made possible by the fact that the end area of the sliver tube 14' is formed by a flexible hose 16'. It is harmless in this case for a certain length of the sliver 5' to travel into the vacuum duct 2. For starting the operation of a spinning station 4, the counterpiece 36' is then returned into the position illustrated on the left-hand side of the vacuum duct 2 in FIG. 1, in which case the end of the sliver 5' is cut off and is introduced into the drafting unit 3.

Figure 6:
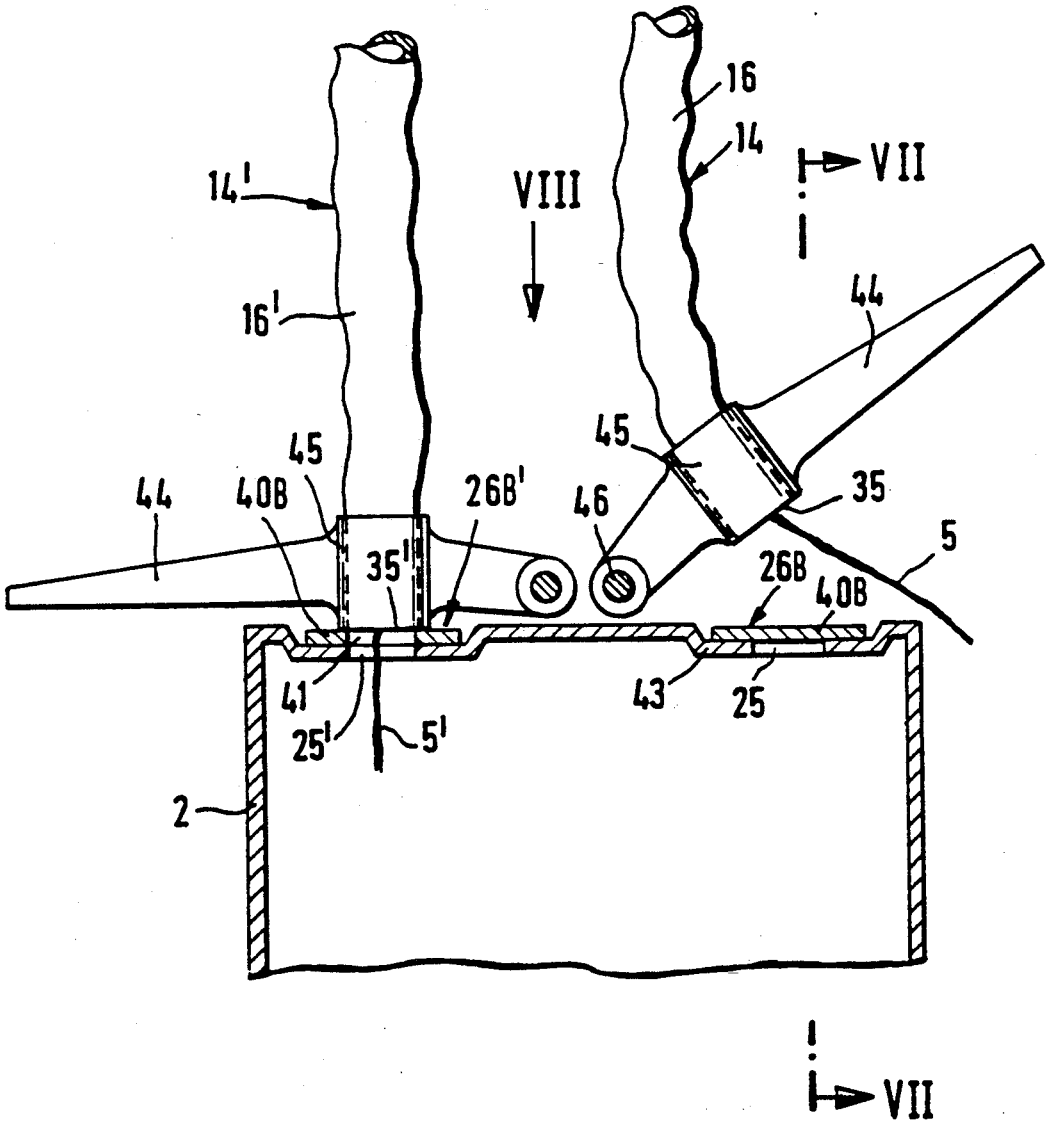
FIG. 6 is a view of a sliver tube which is guided in a restricted manner and which can be connected with a connection opening of the vacuum duct, according to another preferred embodiment of the invention.

FIG. 6 is a cross-sectional view of the area of a vacuum duct 2, where, on the right-hand side, the spinning stations are operative while the connection openings 25 are closed by means of a closing element 26B. In contrast, on the left-hand side, the operation of the spinning stations is interrupted so that the connection openings 25' are connected with the mouths 35' of the pertaining sliver tubes 14', the end piece of which is again formed by a flexible hose piece 16'.

Figure 7:
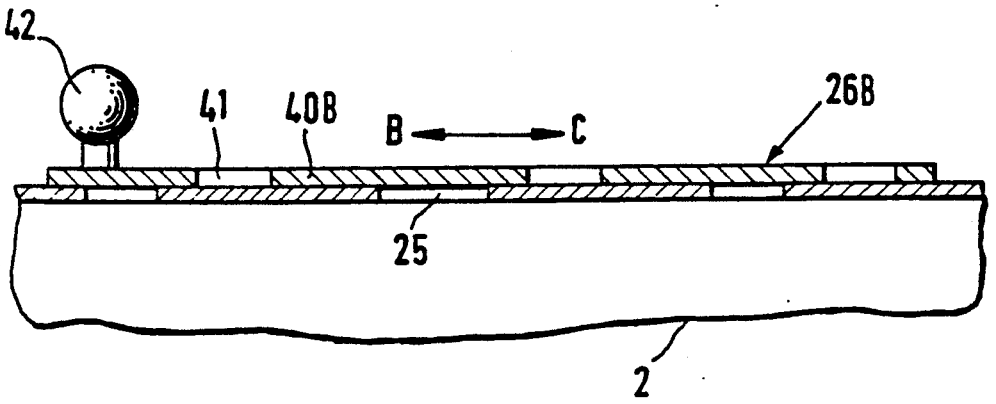
FIG. 7 is a sectional view along the sectional plane VII-VII of FIG. 6.

In the case of this embodiment, the closing element 26B extends along several spinning stations, as illustrated particularly in FIG. 7. The closing element 26B is constructed in this case as a so-called section slide 40. This section slide extends along several spinning stations 4 and comprises a number of openings 41 which, during the operation, are not in alignment with the connection openings 25 of the vacuum duct 2; see FIG. 7. By means of a grip 42, the section slide 40 can be displaced corresponding to the direction B and C of the arrow into the longitudinal direction of the spinning machine 1 so that, when the operation is interrupted, the openings 41 are in alignment with the connection openings 25 of the vacuum duct 2; see also left-hand side of FIG. 6. For the displacing of the section slide 40, the top side of the suction duct 2 is provided with a corresponding guide groove 43.

In the embodiment according to FIG. 6, the sliver tubes 14 are guided in a restricted manner, specifically by means of one lever 44 respectively which, for the guiding of the flexible hose 16 of the sliver tube 14, has a sleeve-type area 45 in the area of the mouth 35. The lever 44 can be swivelled about a shaft 46 extending in the longitudinal direction of the machine.

Figure 8:
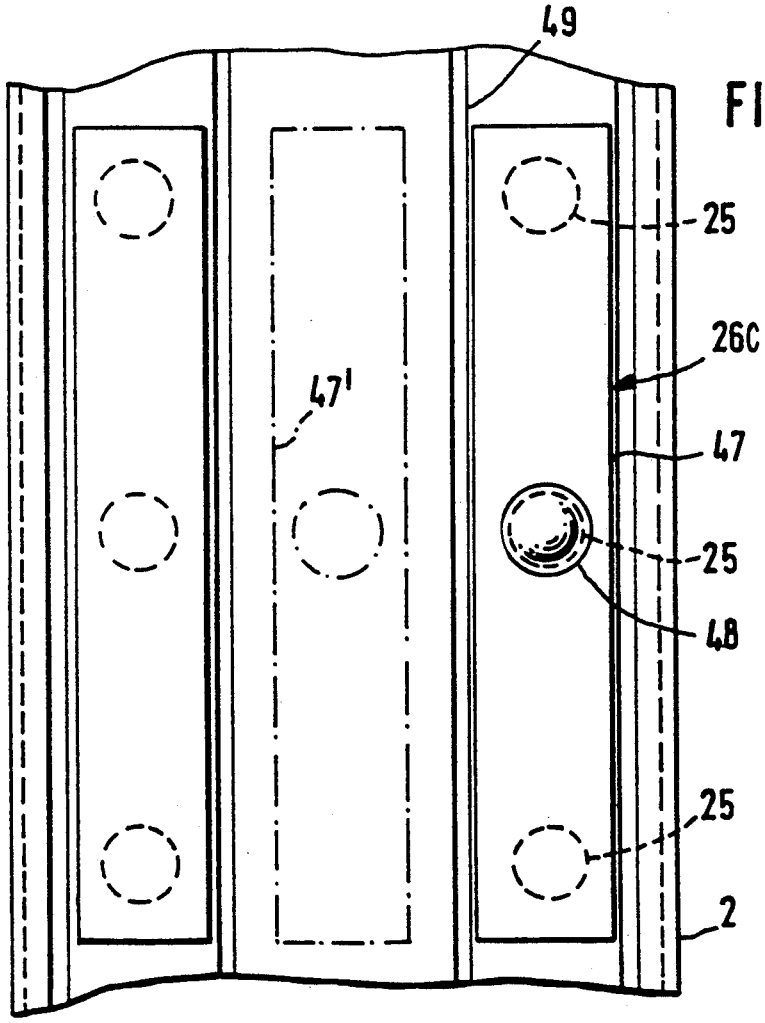
FIG. 8 is a view in the direction of arrow VIII of FIG. 6 in the case of a modified closing element.

The closing element 26C according to FIG. 8 is constructed as a sheet metal strip 47 which extends in the longitudinal direction of the machine again along several spinning stations 4 and in this case covers several connection openings 25. When, for the taking-in of the sliver 5, the suction air of the vacuum duct 2 is required, the sheet metal strip 47 can simply be removed by means of a grip 48 from the recess 49 of the top side of the vacuum duct 2 and deposited at a different location, as indicated by a dash-dotted line with the reference number 47'.

Figure 9:
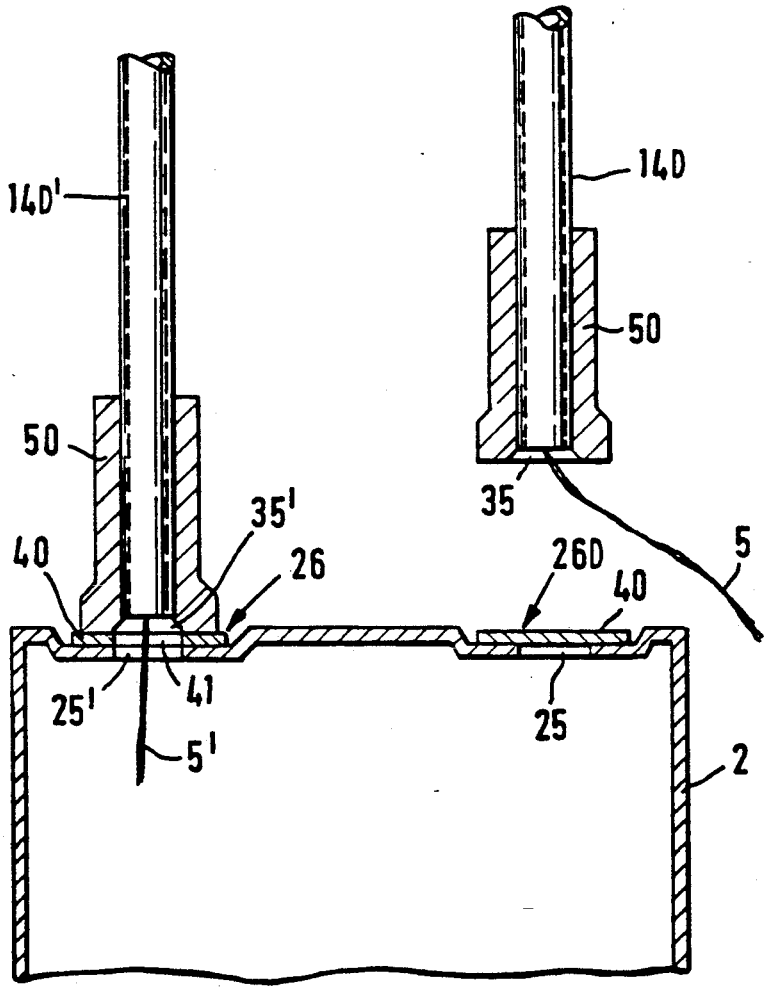
FIGS. 9 to 12 are schematic views of different embodiments of the invention for the connecting of the sliver tubes with the connection openings of the vacuum duct.

In the embodiment according to FIG. 9, the sliver tube 14D has an axially displaceable sleeve 50 in the area of its mouth 35. On the right-hand side of FIG. 9, it is illustrated in the position in which the pertaining spinning station 4 is operative. This development has the result that it is no longer required to mount a flexible hose in the end area of the sliver tube 14D.

In order to take in a sliver 5 when the spinning station 4 is interrupted, as required by means of the displacing of the sleeve 50, the mouth 35 of the sliver tube 14D can be connected with the connection opening 25, as illustrated on the left-hand side in FIG. 9.

Figure 10:
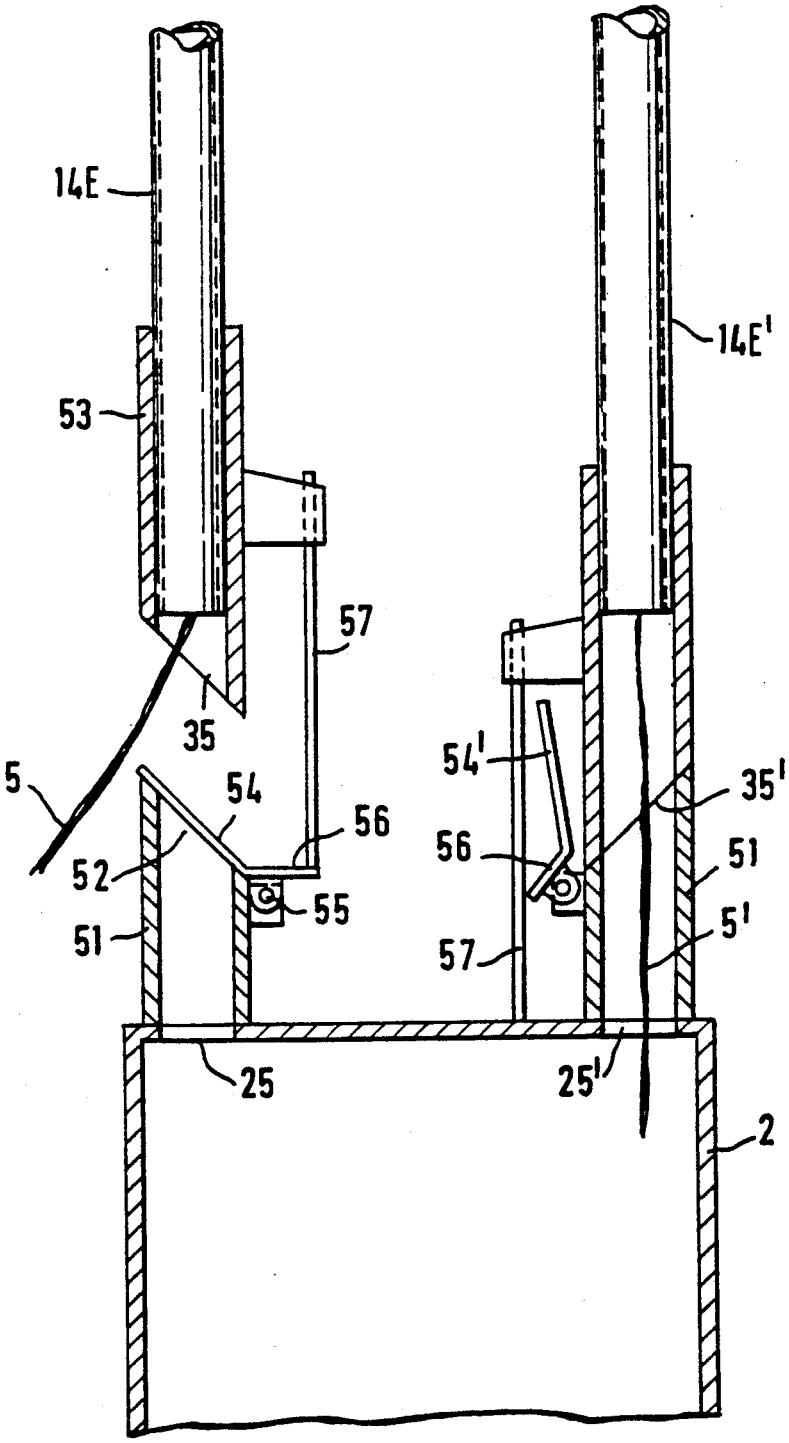

In the embodiment according to FIG. 10, connecting sleeves 51 are again mounted on each side of the machine for each connection opening 25, the inlet opening 52 of the connecting sleeves 51 being cut off in a slanted manner. The sliver tube 14E again has a sleeve 53 which can be displaced in the longitudinal direction and which comprises the mouth 35 which is also cut off in the same slanted manner. There are two lock-in positions.

On the left-hand side of FIG. 10, the spinning position is illustrated in which the sleeve 53 is lifted off the connecting sleeve 51 so that the sliver 5 can be fed to the spinning station 4 which is not shown. The inlet opening 52 of the connecting sleeve 51 is closed off by means of a light hinged lid 54 which can be swivelled about a shaft 55 of the connecting sleeve 51. As required, specifically when a sliver 5 is to be taken in at a spinning station 4, a tappet 57, which is held on the sleeve 53, presses against a lengthening 56 of the hinged lid 54. By means of the application of the sleeve 53 to the connecting sleeve 51, as shown on the right-hand side of FIG. 10, the tappet 57 then presses on the lengthening 56 and opens the hinged lid 54; see position 54' in FIG. 10. As a result, the connection opening 25 is opened up for the taking-in of the sliver 5.

Figure 11:
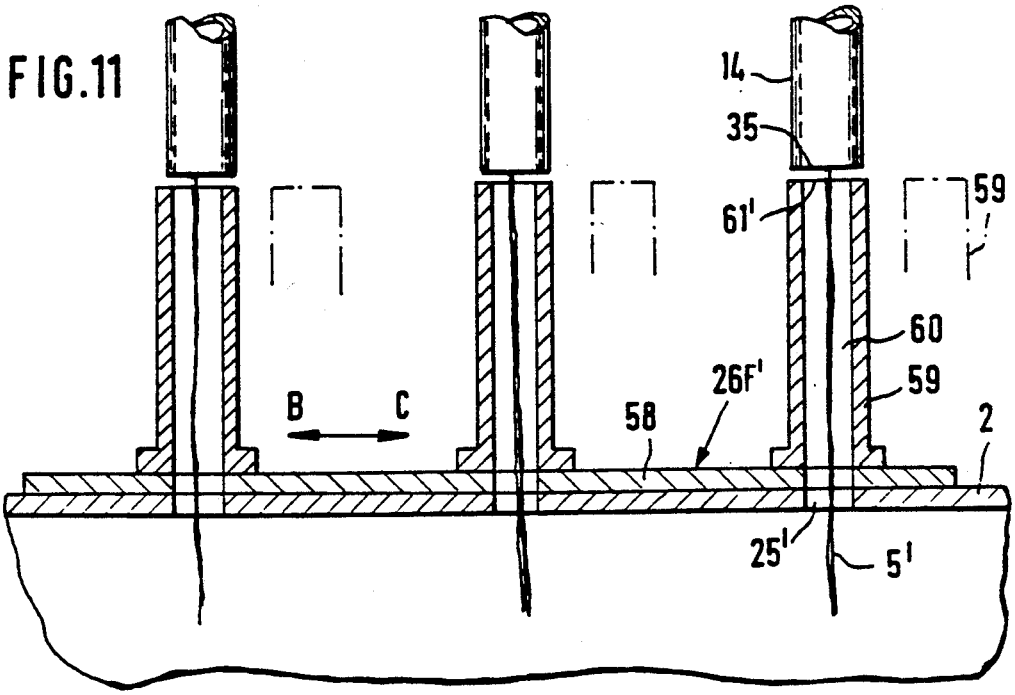

In the embodiment according to FIG. 11 which illustrates the taking-in of slivers 5' on several spinning stations 4 situated next to one another, the closing element 26F, which is in position 26F', comprises a sheet metal strip 58 to which several connecting sleeves 59 are welded. Together with the sheet metal strips 58, they can be manually displaced corresponding to the directions of the arrows B and C.

For the taking-in of slivers 5, the bores 60 of the connecting sleeves 59 can be brought to coincide with the connection openings 25 of the vacuum duct 2. The upper boundary 61—in FIG. 11 in Position 61'—has a very slight distance from the mouth 35 of the pertaining sliver tube 14. There is only a very small gap so that the danger of an impermissible entering of secondary air is slight.

When the sheet metal strip 58' is displaced into its operative position, the connection openings 25 are closed. The end of the sliver 5 can then be gripped and placed in the drafting unit which is not shown.

Figure 12:
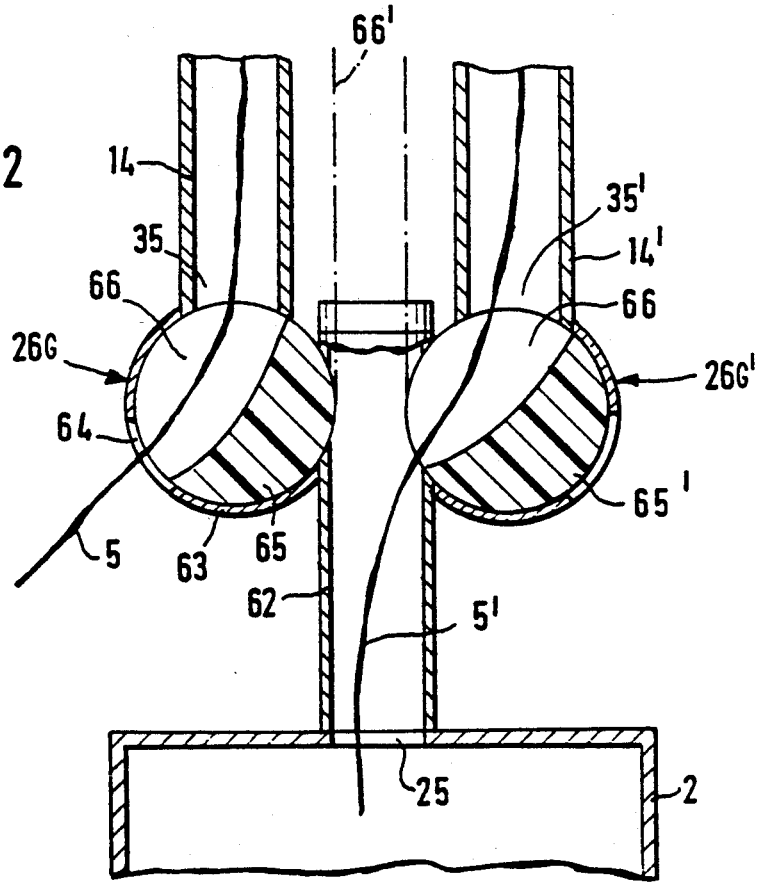

In the embodiment according to FIG. 12, the vacuum duct 2 on its top side has a row of connection openings 25 only in the machine center. Each connection opening 25 is firmly connected to a connecting sleeve 62 which is welded on. The connecting sleeves 62 are followed by closing elements 26G which are constructed as rotary locks. They comprise a short pipe piece 63 which, in the direction of the drafting unit, is provided with an outlet opening 64 and in which a plastic preform 65 can be moved in a rotatable manner. The rotating may, for example, take place by personnel on the platform 11 by way of a cable control 66' indicated by a dash-dotted line.

On the left-hand side of FIG. 12, the spinning position is indicated in which the sliver 5 travels to the drafting unit which is not shown. On the right-hand side, the intake position for a sliver 5' is outlined, in which case the interior of the sliver tube 14' was connected with the connection opening 25 of the vacuum duct 2 by a rotating of the plastic preform 65 into position 65'. For this purpose, the plastic preform 65 has a corresponding passage duct 66 which can be brought into the corresponding positions.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning machine comprising:

a plurality of spinning stations, a sliver conveying system including sliver conveyor tubes for conveying sliver to the spinning stations from sliver containing cans a vacuum duct extending along a plurality of the spinning stations, a connection opening to the vacuum duct at each spinning station for connecting the vacuum duct to a respective sliver conveyor tube to assist in starting conveyance of sliver through the conveyor tube, and selectively operable connection opening cover devices for closing the respective connection opening at a spinning station during normal spinning operations and for opening the respective connection opening at a spinning station during interruption of spinning operation.

2. A spinning machine according to claim 1, wherein the mouth of a sliver tube facing a respective spinning station is provided in the direct proximity of the connection opening.

3. A spinning machine according to claim 2, wherein the area of the mouth of the sliver tube is guided in a restricted manner.

4. A spinning machine according to claim 3, wherein the mouth of the sliver tube is selectively applicable in the vertical direction to the connection opening.

5. A spinning machine according to claim 2, wherein the connection openings are arranged on a top side of the vacuum duct.

6. A spinning machine according to claim 5, wherein the area of the mouth of the sliver tube is guided in a restricted manner.

7. A spinning machine according to claim 6, wherein the mouth of the sliver tube is selectively applicable in the vertical direction to the connection opening.

8. A spinning machine according to claim 7, wherein the connection opening cover devices include a common closing element for several of the connection openings.

9. A spinning machine according to claim 6, wherein the connection opening cover devices include a common closing element for several of the connection openings.

10. A spinning machine according to claim 5, wherein the connection opening cover devices include a common closing element for several of the connection openings.

11. A spinning machine according to claim 2, wherein the connection opening cover devices include a common closing element for several of the connection openings.

12. A spinning machine according to claim 1, wherein the connection openings are arranged on a top side of the vacuum duct.

13. A spinning machine according to claim 1, wherein the connection opening cover devices include a common closing element for several of the connection openings.

14. A spinning machine according to claim 1, wherein the connection opening cover devices include a common closing element for several of the connection openings.

* * * * *